US005438912A

United States Patent [19]

Tonsor

[11] Patent Number: 5,438,912

[45] Date of Patent: Aug. 8, 1995

[54] HYDRAULIC ROTARY ACTUATOR

[75] Inventor: Andrew J. Tonsor, East Peoria, Ill.

[73] Assignee: Caterpillar Inc., Peoria, Ill.

[21] Appl. No.: 310,061

[22] Filed: Sep. 21, 1994

[51] Int. Cl.[6] ..... F01B 13/00

[52] U.S. Cl. ..... 92/54; 92/120; 92/121; 92/125; 414/694

[58] Field of Search ..... 92/54, 55, 120, 121, 92/125, 67; 414/694, 687; 91/196, 210

[56] References Cited

U.S. PATENT DOCUMENTS

| | | | |
|---|---|---|---|
| 2,994,446 | 8/1961 | Auwelaer et al. | 92/125 |
| 3,034,670 | 5/1962 | Lafian . | |
| 3,155,013 | 3/1964 | Rumsey | 92/120 |
| 3,155,351 | 11/1964 | Lear . | |
| 3,184,980 | 5/1965 | Schell . | |
| 3,278,046 | 10/1966 | Shumaker . | |
| 3,330,420 | 7/1967 | Walker . | |
| 3,495,727 | 2/1970 | Long . | |
| 3,805,969 | 4/1974 | Bilocq . | |
| 3,811,577 | 5/1974 | Yancey . | |
| 3,884,158 | 5/1975 | Rumell . | |
| 4,345,509 | 8/1982 | Bridwell et al. . | |
| 4,524,875 | 6/1985 | Jamieson . | |
| 4,746,264 | 5/1988 | Kishi et al. | 414/687 |

FOREIGN PATENT DOCUMENTS

| | | | |
|---|---|---|---|
| 1116361 | 11/1961 | Germany . | |
| 919591 | 2/1963 | United Kingdom . | |
| 187272 | 11/1966 | U.S.S.R. . | |
| 0861776 | 9/1981 | U.S.S.R. | 92/125 |

*Primary Examiner*—Thomas E. Denion
*Attorney, Agent, or Firm*—Claude F. White

[57] ABSTRACT

An hydraulically powered rotary actuator for rotating a first portion of a work machine relative to a second portion of the work machine has inner and outer rings enclosed by first and second cover plates. The inner and outer rings are spaced apart to define an hydraulic power chamber to which pressurized fluid is supplied to rotate one of the inner or outer rings. The first portion of the work machine is connected to the rotatable ring and rotates with it. A large diameter bearing assembly rotatably supports the rotatable ring and the first portion of the work machine. Most prior work machines with rotatable car or upper structure require large expensive components including gear reduction assemblies, an hydraulic motor, and large diameter swing gear. The subject actuator simplifies the construction by eliminating many of the prior components.

12 Claims, 3 Drawing Sheets

HYDRAULIC ROTARY ACTUATOR

TECHNICAL FIELD

This invention relates generally to a work machine having a rotatable upper structure and more particularly to an hydraulic rotary actuator which rotates the upper machine structure.

BACKGROUND ART

Current large size hydraulic excavating machines achieve 360 degrees of swing of the upper structure and associated work implements with a swing drive group which includes an hydraulic motor, a gear reduction mechanism, a very large swing gear, and a swing bearing. This type of swing apparatus is large and expensive and requires considerable space.

Small type of excavators, usually referred to as backhoe machines, utilize a small rotary actuator to rotate the backhoe linkage. One type of small rotary actuators is shown in U.S. Pat. No. 4,345,509, issued Aug. 24, 1982, to J. W. Gridwell et al. In this patent, a vane is bolted to the center shaft and rotates when hydraulic pressure is applied to the inner chamber. For application with a backhoe machine, the backhoe mechanism is attached to the center rotating shaft. Torque reaction is absorbed through the stator which bolts to the outer barrel of the actuator. The barrel is non-rotatable connected to the main frame, or other non-rotatable portion, of the machine. Since this type of actuator is small in diameter in order to fit between the backhoe mechanism and the frame, it has limited torque capacity and can rotate only about plus or minus 90 degrees.

The present invention is directed to overcoming one or more of the problems as set forth above.

Disclosure of the Invention

In one aspect of the present invention, a hydraulic rotary actuator for rotating a first machine portion relative to a second machine portion includes inner and outer concentric rings and first and second cover plates. A sealed fluid chamber is defined by the first and second rings and the first and second cover plates. The first and second rings each have a vane connected thereto with the vanes positioned within the fluid chamber. One of the rings is secured against rotation while the other ring is rotatably supported on a bearing assembly. The first machine portion is adapted to be connected to the rotatable ring.

Most small and medium size backhoe work machines have rotational motion of the backhoe mechanism limited to about plus and minus 90 degrees. This limitation is the result of the size of the fluid actuator and the design of the backhoe mechanism, wherein it is normally connected to the non-movable frame of the work machine.

The subject invention provides a work machine and attached work implement which is capable of 360 degrees, or more, of rotation. A large diameter hydraulic rotary actuator mounts the upper portion of the machine and associated work implement for rotation with the actuator. The rotary actuator provides rotation of the work implement through an arc of about 300 to 320 degrees and a linear actuator or rotary fluid motor provides additional rotation to increase the arc to 360 degrees or more.

Although the subject invention provides rotation of the upper machine portion relative to the lower machine portion, the subject machine can also retain the plus and minus 90 degree rotation of the backhoe mechanism relative to the upper and lower machine portions. This adds to the machine versatility for working close to obstacles and close to walls.

BEST MODE FOR CARRYING OUT THE INVENTION

Figure 1:
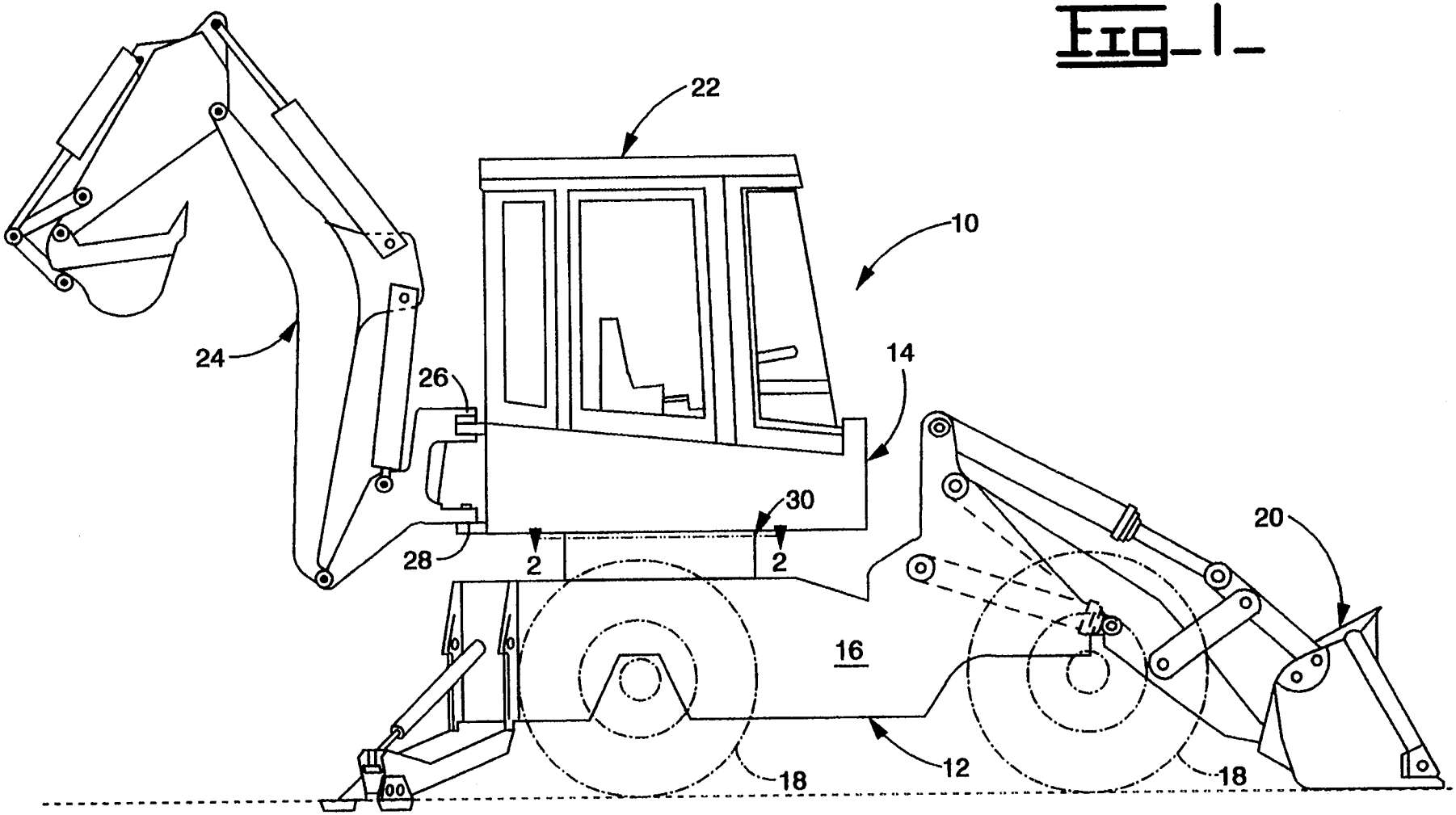
FIG. 1 is a diagrammatic side elevational view of a work machine incorporating the subject invention.
Figure 2:
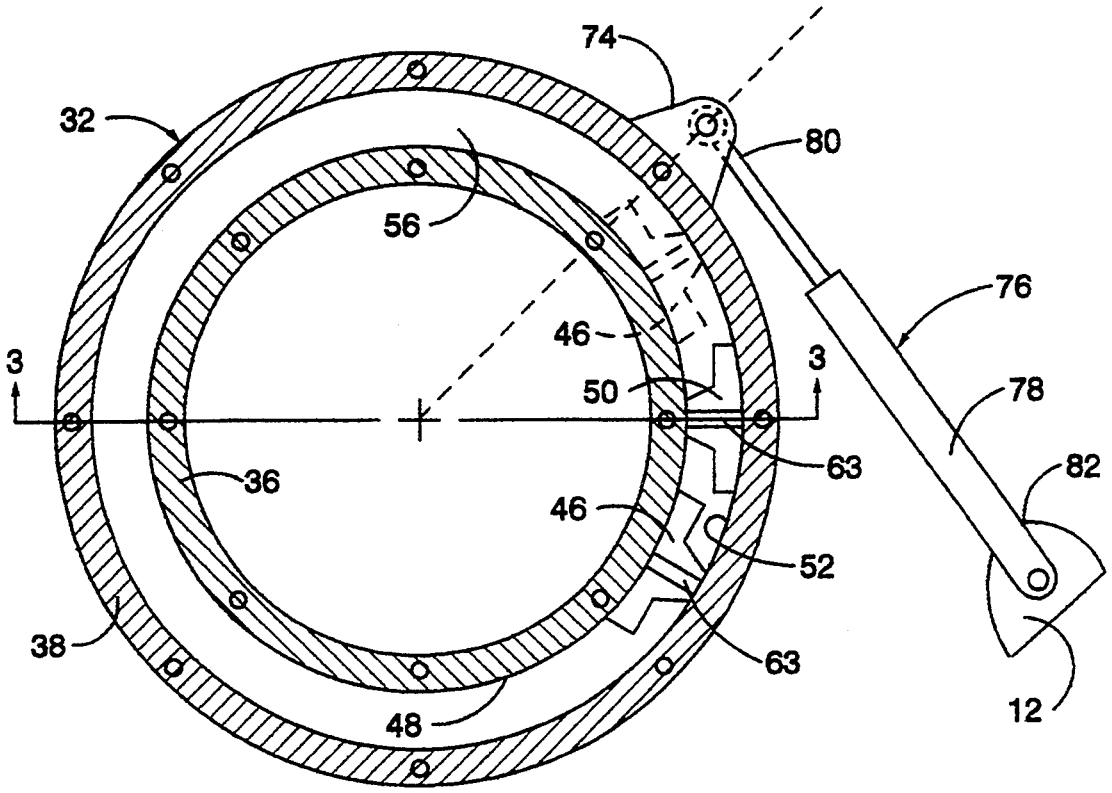
FIG. 2 is a diagrammatic sectional plan view of the subject hydraulic rotary actuator, taken generally along the lines 2—2 of FIG. 1.
Figure 3:
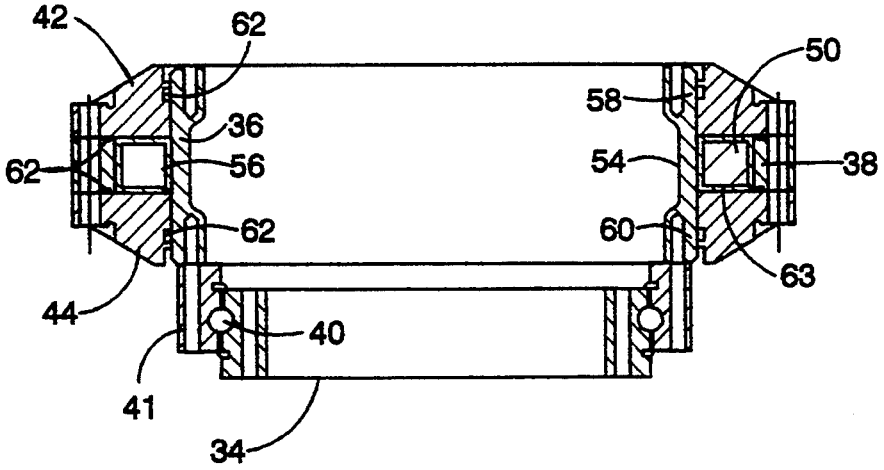
FIG. 3 is a diagrammatic sectional view taken generally along the lines 3—3 of FIG. 2.

Referring to the drawings, a work machine 10 has a lower portion 12 and an upper portion 14. The lower portion 12 includes a main frame 16 supported by a plurality of wheel structures 18, and can include a first work implement 20 connected to the main frame 16. The upper portion 14 includes an operator's station 22 and a second work implement 24 connected to the operator's station 22 at first and second connections 26,28. The work machine 10 includes means 30 for rotating the rotatable upper portion 14 relative to the non-rotatable lower portion 12. The rotating means 30 includes an hydraulic rotary actuator apparatus 32. The rotary actuator apparatus 32 includes a support member 34 connected to the lower machine portion 12, inner and outer concentric circular rings 36,38, a bearing assembly 40, and first and second cover plates 42,44. The bearing assembly 40 includes a supporting ring 41 which connects to the inner ring 38. The inner ring 36 has a first radially extending vane 46 connected to the external surface 48 of the inner ring 36, and the outer ring 38 has a second radially extending vane or stator 50 connected to the internal surface 52 of the outer ring 38. The outer ring 38 is adapted to encircle a first portion 54 of the inner ring 36 and defines a circular fluid chamber 56. The first and second vanes 46,50 are adapted to be positioned within the chamber 56.

The first and second cover plates 42,44 are adapted to connect to the outer ring 38 and encircle second and third portions 58,60 respectively of the inner ring 36 to close off the chamber 56. A plurality of seals 62 are positioned between the first and second cover plates 42,44 and the inner and outer rings 36,38 to prevent leakage of fluid from the chamber 56. A rectangular seal 63 is positioned around each of the vane 46 and the stator 50 to prevent leakage of fluid past the vane 46 or stator 50. Means 64, for supplying pressurized fluid into the chamber 56 on each side of the second vane 50 to rotate the inner ring 36, includes a fluid pump 66, reservoir 68, and a plurality of fluid lines 70. The upper machine portion 14 is connected to the inner ring 36 and is adapted to rotate with the inner ring 36. A first control valve 72 controls the supply of pressurized fluid to the chamber 56. A torque reaction mechanism 74 is connected to the outer ring 38 and to the lower machine portion 12 to absorb the torque forces and prevent the outer ring 38 from rotating. The bearing assembly 40 is connected to the support member 34 and is adapted to rotatably support the inner ring 36 and the upper machine portion 14.

When pressurized fluid is supplied into the chamber 56, the inner ring 36, and attached upper machine portion 14, is adapted to rotate, relative to the outer ring 38, in an arc of about 320 degrees. Additional rotation of the inner ring 36 is possible with means 76, which is adapted to rotate the outer ring 38 within a limited arc. Means 76 includes a fluid cylinder 78 which has a first end 80 connected to the outer ring 38, and a second end portion 82 connected to the lower non-rotatable machine portion 12. Once the outer ring 38 has been rotated, the inner ring 36 can rotate further and can therefore rotate totally in an arc of 360 degrees or more. A second control means 84, for supplying pressurized fluid to the fluid cylinder 78, includes a second control valve 86, pump 66, reservoir 68, and fluid lines 88.

Figure 4:
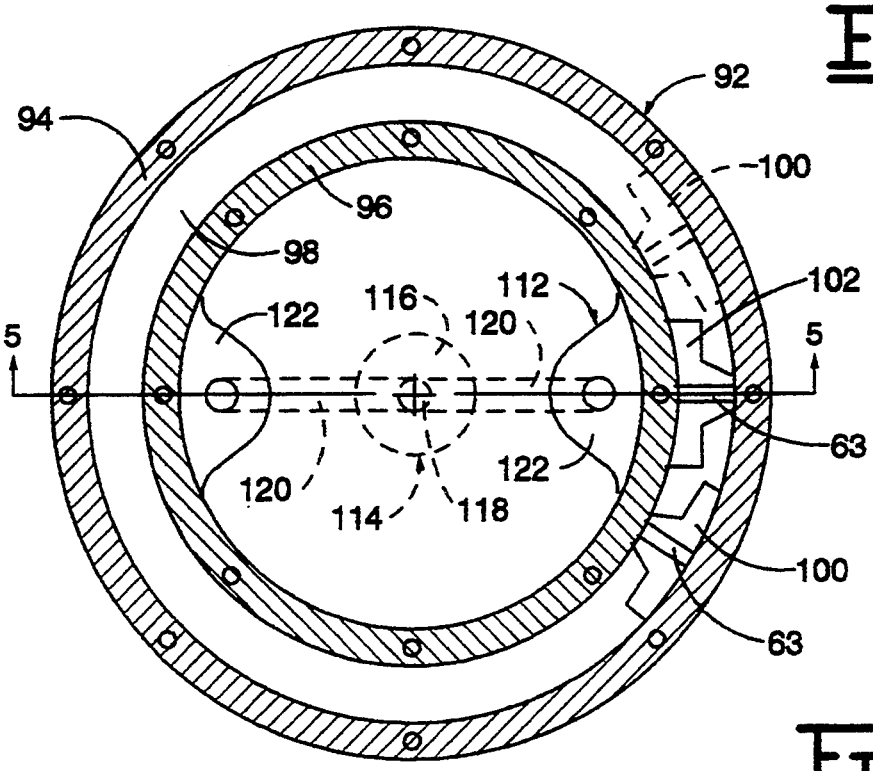
FIG. 4 is a diagrammatic sectional view similar to FIG. 2 and showing a second embodiment of the subject invention.
Figure 5:
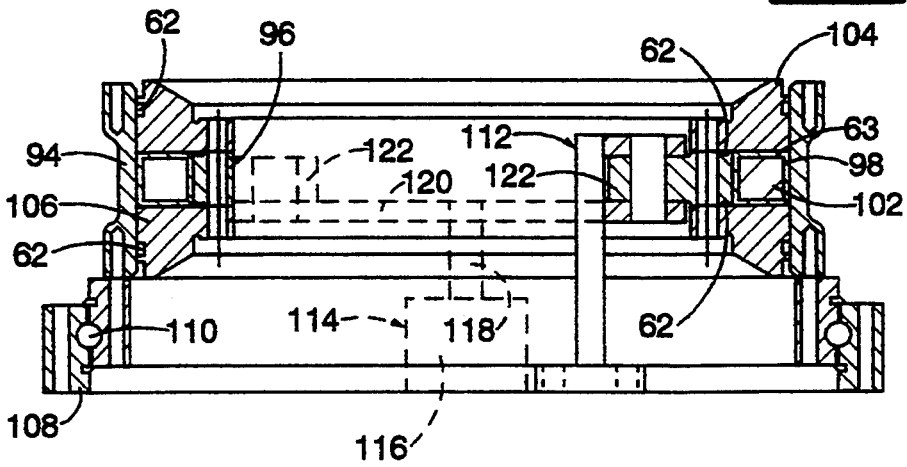
FIG. 5 is a diagrammatic sectional view taken generally along the lines 5—5 of FIG. 4.
Figure 6:
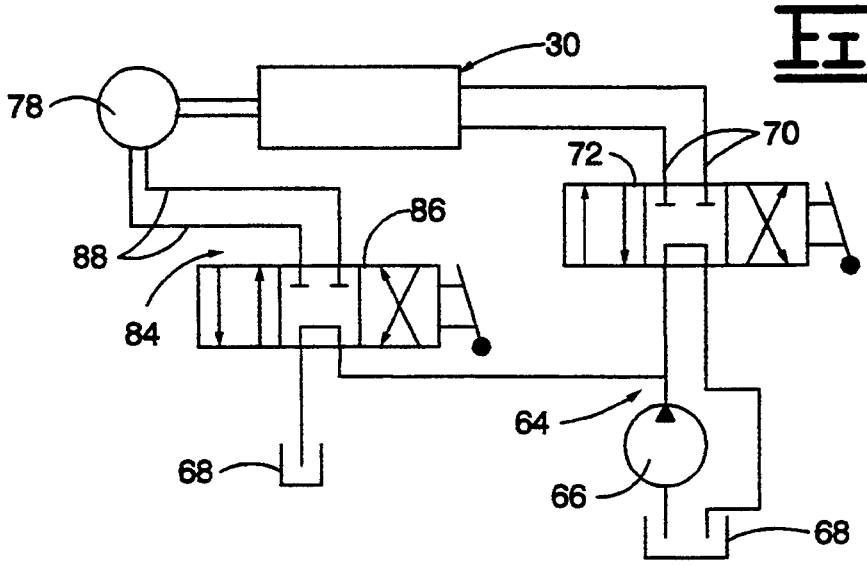
FIG. 6 is a schematic of an hydraulic circuit for operating the subject invention.

With particular reference to FIGS. 1, 4, 5, and 6, a second embodiment of the subject invention is shown. This embodiment illustrates a hydraulic rotary actuator apparatus 92 for rotating the upper portion 14 of the work machine 10 and includes an outer rotatable ring 94 and an inner ring 96. The upper portion 14 of the work machine is connected to the outer ring 94 and is adapted to rotate with the outer ring 94. The outer and inner rings 94,96 are concentric and the outer ring 94 encircles the inner ring 96 to define a circular fluid chamber 98 therebetween. The outer ring 94 has a first radially extending vane 100 connected thereto and the inner ring 96 has a second radially extending vane, or stator, 102 connected thereto. The first and second vanes 100,102 are adapted to be positioned within the fluid chamber 98. First and second cover plates 104,106 are positioned within said outer ring 94 and enclosed the inner ring 96 to close the chamber 98. A support member 108 is connected to the lower non-rotatable machine portion 12, and a bearing assembly 110 rotatably supports the rotatable outer ring 94 and the upper machine portion on the support member 108.

As in previously described embodiment, a plurality of seals 62 are positioned between the first and second cover plates 104,106 and the inner and outer rings 94,96 to prevent leakage of fluid from the chamber 98. Seals 63 are also positioned around the vane 100 and the stator 102, as in the previously described embodiment. Also the means 64 for supplying pressurized fluid into the chamber 98 on each side of the second vane 102, to rotate the outer ringer 94, includes the fluid pump 66, the reservoir 68, the plurality of fluid lines 70, and the control valve 72. A torque reaction mechanism 112 is connected to the inner ring 96 and to the lower machine portion 12 through the support member 108 to absorb the torque forces and prevent the inner ring 96 from rotating.

When pressurized fluid is supplied into the chamber 98, the outer ring 94, and attached upper machine portion 14, is adapted to rotate, relative to the inner ring 96, in an arc of about 300 degrees. Additional rotation of the outer ring 94 is possible with means 114, which is adapted to rotate the inner ring 96 within a limited arc. Means 114 can include a fluid motor 116, or linear fluid device positioned on the mainframe 16 or lower portion 12. A shaft 118 is connected to the inner ring 96 by linkage 120 and one or more ears 122. Once the inner ring 96 has been rotated within its limited arc, the outer ring 94 can rotate further to complete a total rotation of 360 degrees or more. Actuation of the fluid motor 116 is by the second control means 84, including the second control valve 86, pump 66, reservoir 68, and fluid lines 88. The motor 116 will need to be large enough to resist the torque reaction generated by the second work implement 24. When a motor 116, or similar linear device is used, the torque reaction mechanism 112 is removed.

Industrial Applicability

With reference to the drawings and the previous detailed description, the subject hydraulic rotary actuator apparatus 32,92 is particularly useful for rotating an upper portion 14 of a work machine 10 relative to a lower non-rotatable machine portion 12. The upper machine portion 14 includes a second work implement 24 which rotates with the upper portion 14. Rotating of the second work implement 24 a complete 360 degrees provides versatility to the work machine 10 and allows the machine 10 to work in areas not previously available to such work machines 10. The hydraulic rotary actuator apparatus 32,92 are self contained units which require little space yet provide high torque capacity, and constant torque throughout the swing range. Constant torque is desirable for controllability.

To rotate the upper portion 14, and the attached second work implement 24, the first control valve 72 is shifted and pressurized fluid is directed from the fluid pump 66 into fluid lines 70 and into the fluid chamber 56,98. The rotatable ring 36,94 is rotated by the pressurized fluid acting against the stator 50,102 until the desired position of the second work implement 24 is reached. If additional rotation is desired, the second control valve is shifted to direct pressurized fluid to the fluid cylinder 78, or the fluid motor 116, to rotate the normally stationary rings 38,96 in a controlled arc. Since the position of the stator 50,102 has also moved along with the rings 38,96, the rotatable rings 36,94 can now rotate further and complete a 360 degree rotation.

Other aspects, objects and advantages of this invention can be obtained from a study of the drawings, the disclosure, and the appended claims.

I claim:

1. A hydraulic rotary actuator for rotating a first rotatable machine portion relative to a second non-rotatable machine portion, comprising:

a support member connected to said second machine portion;

an inner ring having a first radially extending vane connected thereto;

an outer ring having a second radially extending vane connected thereto, said outer ring encircling a first portion of said inner ring and define a circular chamber therebetween, said first and second vanes being positioned within said chamber;

a bearing assembly supporting said inner ring and said first rotatable machine portion on said support member;

first and second cover plates enclosing said outer ring and encircling second and third portions respectively of said inner ring to close said chamber;

a plurality of seals positioned between said first and second cover plates and said inner and outer rings;

a seal positioned around each of the first and second vanes;

a torque reaction apparatus connecting said outer ring to said second non-rotatable machine portion; and means for supplying pressurized fluid into said chamber on each side of said second vane.

2. A rotary actuator, as set forth in claim 1, wherein said inner ring is adapted to rotate relative to said outer ring in an arc of about 320 degrees.

3. A rotary actuator, as set forth in claim 1 including means for rotating said outer ring.

4. A rotary actuator, as set forth in claim 3, wherein said rotating means includes a fluid cylinder having a first end portion connected to said outer ring and a second end portion connected to said second machine portion.

5. A rotary actuator, as set forth in claim 3, wherein said inner ring is adapted to rotate relative to said second machine portion in an arc of about 360 degrees.

6. A rotary actuator, as set forth in claim 1, wherein said first machine portion is connected to said inner ring.

7. A rotary actuator, as set forth in claim 3, including first control means for supplying pressurized fluid to said chamber and second control means for supplying power to said rotating means.

8. A rotary actuator, as set forth in claim 4, including first control means for supplying pressurized fluid to said chamber and second control means for supplying pressurized fluid to said fluid cylinder.

9. A work machine having a lower portion including a main frame, and an upper portion including an operator's station and a work implement connected to said operator's station, the improvement comprising:

means for rotating the upper machine portion relative to the lower machine portion, said means including:

a support member connected to said lower machine portion;

an inner circular ring having a radially extending vane connected thereto;

an outer circular ring having a radially extending stator connected thereto, said outer ring being concentric to said inner ring and encircling a first portion of said inner ring to define a chamber therebetween, said stator and said vane being positioned within said chamber;

a bearing assembly connected to said support member and adapted to rotatably support said inner ring and said upper machine portion;

first and second cover plates enclosing said outer ring and encircling second and third portions respectively of said inner ring to enclose said chamber;

a plurality of seals positioned between said cover plates and said rings;

a seal adapted to encircle each of said vane and said stator;

a torque reaction apparatus connected to said outer ring and to said lower machine portion; and means for supplying pressurized fluid into said chamber on opposite sides of said vane for rotating said inner ring.

10. A work machine, as set forth in claim 9, including means for rotating said outer ring.

11. A work machine, as set forth in claim 10, wherein said means for rotating includes a fluid cylinder having a first end portion connected to said outer ring and a second end portion connected to said lower machine portion.

12. A work machine, as set forth in claim 9, wherein said upper machine portion is connected to said inner ring and is adapted to rotate with said inner ring.

* * * * *